United States Patent [19]

Morgan, Jr.

[11] 4,446,653

[45] May 8, 1984

[54] DEVICE FOR SUPPORTING AND ROTATING A HANGING PLANT

[76] Inventor: Robert H. Morgan, Jr., 22 Birch Rd., Darien, Conn. 06820

[21] Appl. No.: 260,391

[22] Filed: May 4, 1981

[51] Int. Cl.[3] ..... A47G 7/02

[52] U.S. Cl. ..... 47/67; 185/27; 185/32; 185/37; 267/69; 267/157; 47/39

[58] Field of Search ..... 47/67, 39; 40/473; 185/27, 37, 39, 40, 31, 38, 32, 40 L; 267/157, 69, 73, 152, 74; 57/225, 226

[56] References Cited

U.S. PATENT DOCUMENTS

| | | | |
|---|---|---|---|
| 296,946 | 4/1884 | Gardner | 267/69 |
| 1,749,117 | 3/1930 | Weichsel | 267/74 |
| 2,024,155 | 12/1935 | Foster | 57/225 |
| 3,602,337 | 8/1971 | Cain | 185/37 X |
| 3,604,536 | 9/1971 | Dinnerstein | 185/40 R |
| 3,832,841 | 9/1974 | Cole | 57/226 X |
| 4,207,696 | 6/1980 | Hyman et al. | 40/473 |
| 4,216,619 | 8/1980 | Espy | 47/67 |
| 4,238,002 | 12/1980 | Hexamer | 47/67 X |

FOREIGN PATENT DOCUMENTS

| | | | |
|---|---|---|---|
| 2839493 | 3/1980 | Fed. Rep. of Germany | 40/473 |

*Primary Examiner*—Steven A. Bratlie

*Attorney, Agent, or Firm*—St. Onge, Steward, Johnston & Reens

[57] ABSTRACT

A device for supporting a hanging plant and for slowly rotating it to expose different sides to sunlight. The device comprises a cord for attachment at one end to a hook or other fixed object and for attachment at the opposite end to the plant. The cord extends in length and winds in one direction in response to an increase in the weight of the plant by feeding of water and contracts and winds slowly in an opposite direction as the water evaporates from the plant.

4 Claims, 13 Drawing Figures

10
12
14
16
18
20
22
24
25
26
27
28
30
32
34
36
1B
2B
3B
4B

DEVICE FOR SUPPORTING AND ROTATING A HANGING PLANT

BACKGROUND OF THE INVENTION (1) Field of the Invention

The present invention relates to devices for supporting a hanging plant and for slowly rotating it to expose different sides to sunlight. More specifically, the present invention relates to a device that rotates a plant object in one direction when the plant is fed water and that rotates the plant in an opposite direction as water evaporates from the plant object.

(2) Description of the Prior Art

A hanging plant object is typically hung from a fixed object such as a hook on a ceiling or a bracket arm extending inwardly from a wall into a room. The hanging plant object, that is, the pot for containing the plant, the soil and the plant itself, is typically hung adjacent a window to allow the plant to receive natural light. In the case of most hanging plants, the pot is hung in a stationary position and the plant itself tends to receive light from only one side. Thus, the plant tends to grow toward the light and growth of portions of the plant located away from the light is stilted. One way to provide uniform exposure of sunlight to the plant is to periodically manually rotate the plant. However, while this method of providing uniform sunlight to a plant will provide the desired results, most people find it difficult to follow a day-to-day regimine of turning a plant.

Thus, it is an object of the present invention to provide a device for automatically rotating a plant to expose its different sides to sunlight.

SUMMARY OF THE INVENTION

In accordance with the present invention a device for supporting a hanging plant object and for slowly rotating it to expose different sides to sunlight is provided. The device comprises an extensible cord having one end for attachment to a fixed object such as a hook or a bracket arm and having an opposite end for attachment to the plant object. The plant object, which comprises a potting container, soil and the plant itself, is attached to the cord. The cord is longitudinally extensible in response to an increase in weight of the plant object hanging thereon, and more particularly, extends in length when the plant is fed with water. The cord winds in one direction as the cord is extended to rotate the plant object. The cord is longitudinally contractable in response to a decrease in the weight of the plant object. More particularly, as the water evaporates from the plant object, and its weight decreases, the cord winds in an opposite direction to thereby slowly rotate the plant object.

In accordance with one aspect of the present invention, the cord for supporting and rotating the hanging plant comprises an elongate elastic core wherein the core is twisted in one direction about its longitudinal axis. A flexible substantially inextensible length is wound about the core in a general helical pattern along the core axis and has one end attached to one end of the elastic core and another end attached to the opposite end of the elastic core. The inextensible length is wound in a direction opposite to the direction in which the elastic core has been twisted to thereby hold the elastic core in a twisted condition.

When a plant object is initially placed on an unloaded cord, the cord extends in length and winds in a first direction to rotate the plant. The plant is periodically fed with water, thereby adding weight to the plant object. When the water is added, the cord further extends and winds to rotate the plant object until it comes to a rest position. Thereafter, water slowly evaporates from the plant object thus slowly and continuously decreasing the plant object weight. As the weight slowly decreases, the cord contracts and winds in an opposite direction to slowly turn the plant object thereby allowing its different sides to be exposed to sunlight. The rate of evaporation tends to increase during the day because the plant object is warmed as sunlight impinges on it, thereby increasing the speed of rotation of the plant object during the day when it is desirable to expose different sides to sunlight.

In accordance with one aspect of the invention, the elongate elastic core may comprise one or more strands of elastic material. Further, the inextensible length comprises at least one length of twine, small diameter rope or other elongate material that is relatively inextensible in comparison to the elongate elastic core. In accordance with a further aspect of the invention, an appearance covering may be provided to enhance the asthetic qualities of the cord, and, more particularly, a strand of colored yarn may be wrapped in a generally helical pattern around the length of the cord to provide an attractive appearance.

A device in accordance with the present invention provides for exposure of different sides of a hanging plant object to sunlight to thereby provide for uniform growth of the plant. The device operates by periodic feeding of water to the plant which must be done to maintain the plant. The device in accordance with the present invention is simple and does not require electrical motors for rotating the plant nor does it require complicated gearing and numerous parts. Additional advantages of a hanging plant of a device for supporting and rotating a hanging plant in accordance with the present invention will be apparent from the drawings and the detailed description of the invention.

BRIEF DESCRIPTION OF THE DRAWINGS

FIGS. 1–4 show a device in accordance with the present invention during various stages of manufacture, and wherein

DETAILED DESCRIPTION OF THE PREFERRED EMBODIMENT

Figures 1A, 1B, 2A, 2B, 3A, 3B, 4A, 4B:
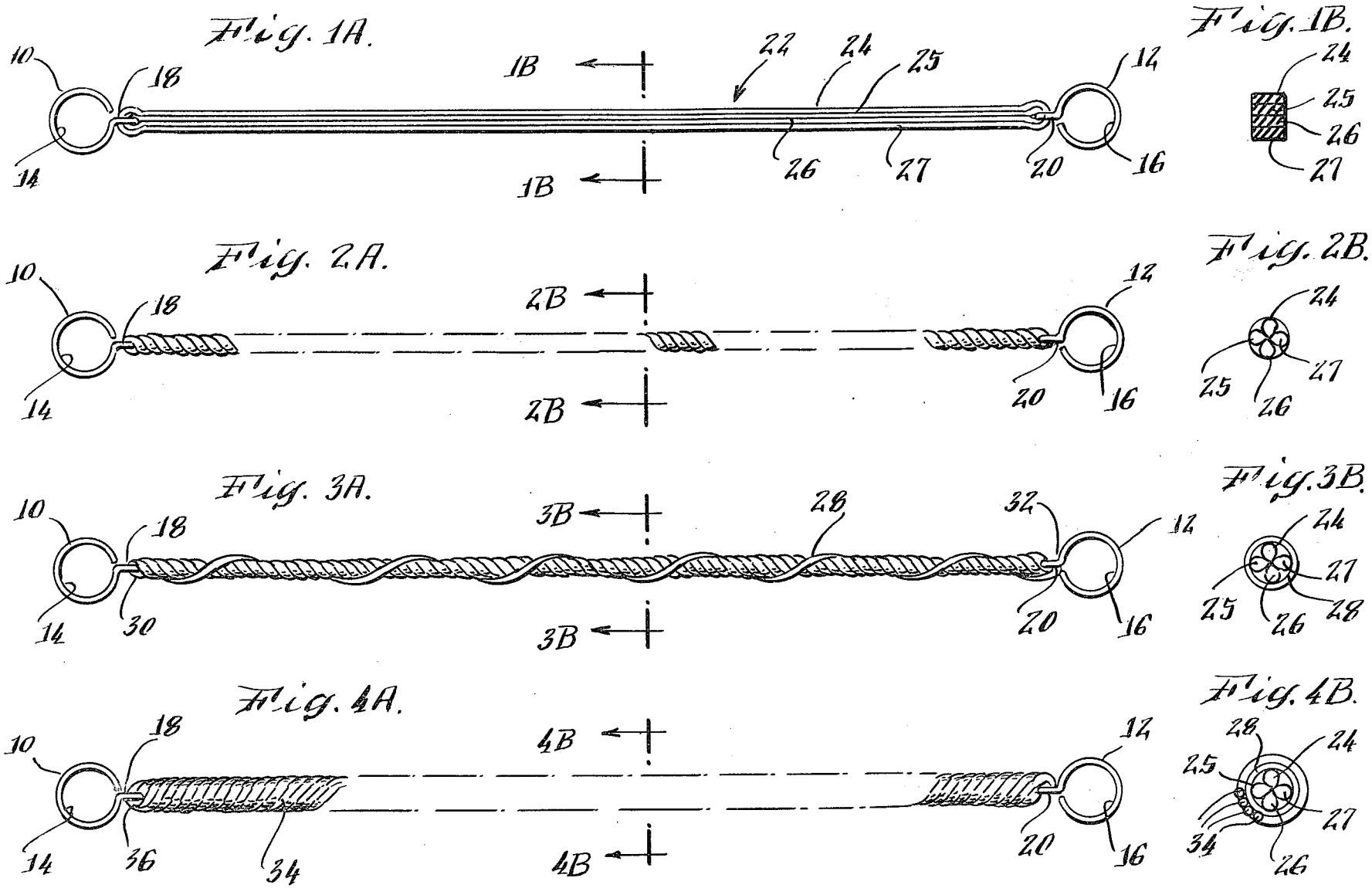
FIG. 1A is a side view of a device prior to twisting of the elongate elastic core.
FIG. 1B is a sectional view along the plane 1B—1B of FIG. 1A.
FIG. 2A is a side view of a device after the elastic core has been twisted.
FIG. 2B is a sectional view along the plane 2B—2B of FIG. 2A.
FIG. 3A is a side view of a device after a substantially inextensible length has been wound around the twisted elastic core.
FIG. 3B is a sectional view along the plane 3B—3B of FIG. 3A.
FIG. 4A is a side view of the device after a helical wrapping of colored yarn has been applied to the exterior of the wound core shown in FIG. 3A.
FIG. 4B is a sectional view along the plane 4B—4B of FIG. 4A.

Referring to FIGS. 1–9, and in particular FIGS. 1–4, the method of manufacture of a device for supporting and turning a hanging plant will now be described. Referring to FIGS. 1A and 1B, the device comprises two end rings 10 and 12 each having, respectively, a large loop 14 and 16 for attachment to a hook on a ceiling or a plant object and having a small loop 18 and 20. An elongate core 22 has one end attached to loop 18 and has an opposite end attached to loop 20. The elastic core may comprise a single strand of elastic material or may comprise several strands. As shown in FIGS. 1A and 1B, the device includes four strands 24, 25, 26 and 27. The ends of these strands are attached to loops 18 and 20 by any conventional means such as tying the strands thereto. In accordance with one aspect of the invention, the strands 24–27 may be formed of two elongate elastic bands hooked on loops 18 and 20. Referring to FIG. 1A, the ring 12 is turned with respect to ring 10 as shown by the arrow to twist the elastic core into the condition shown in FIG. 2A. After the elastic core has been twisted, a flexible substantially inextensible length 28 is wound around core 22. Inextensible length 28 has one end 30 attached by a knot to ring 10. And the inextensible length 28 is wound about core 22 in a generally helical pattern along the longitudinal axis of the core. The inextensible length is wound in a direction opposite to the direction in which the elastic core has been twisted. After the winding of the inextensible length is completed, end 32 is tied to ring 20.

Referring to FIGS. 4A and 4B, the device for supporting and turning a hanging plant may optionally include a cover 34 for enhancing the appearance of the cord. Cover 34 comprises a strand of yarn, preferably colored, wound tightly in a helical pattern along the length of the cord. The yarn 36 is wound in the same direction that inextensible length 28 is wound.

The elongate elastic core 22 may be made of various elastic materials such as, for example, synthetic or natural rubbers and materials having similar elastic properties. The substantially inextensible length 30 may be made from various twines. It is preferred that a multiple nylon filament twine be used. By "substantially inextensible" it is meant that the length 28 has a tendency to resist any substantial elongation when it is pulled in the longitudinal direction.

The use of a device for supporting and rotating a hanging plant will now be described. Referring to FIGS. 5–9, the device is attached to a stationary object such as, for example, a hook 38 which is attached to the ceiling of a room. Hook 38 is shown by way of example only and other stationary mounting means may be used, such as, for example, brackets having arms, such as, for example a bracket having an arm extending outwardly from an interior wall. As shown in FIGS. 5–9, the cord 40 is shown without the appearance cover 34 so that the operation of the cord may be seen and described. Length 28, which is substantially inextensible, prevents the elastic core 22 from untwisting when the cord 40 is in an unloaded condition.

Figure 5:
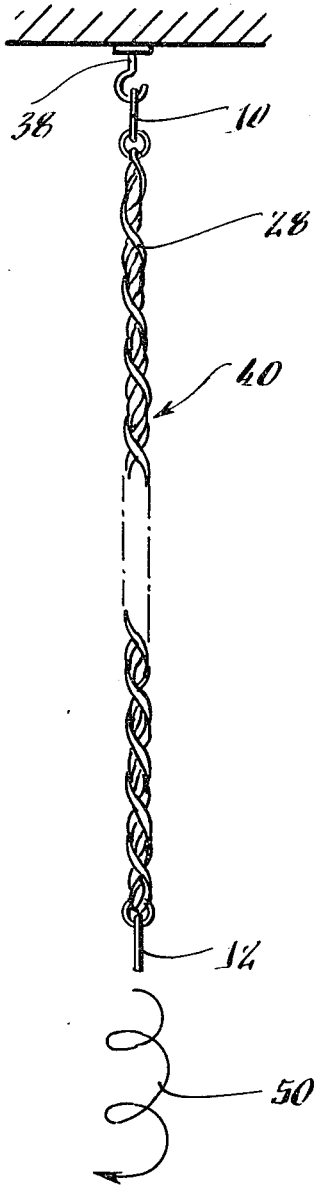
FIG. 5 is a side view of a device in accordance with the present invention in an unloaded condition hung from a ceiling hook.
Figure 6:
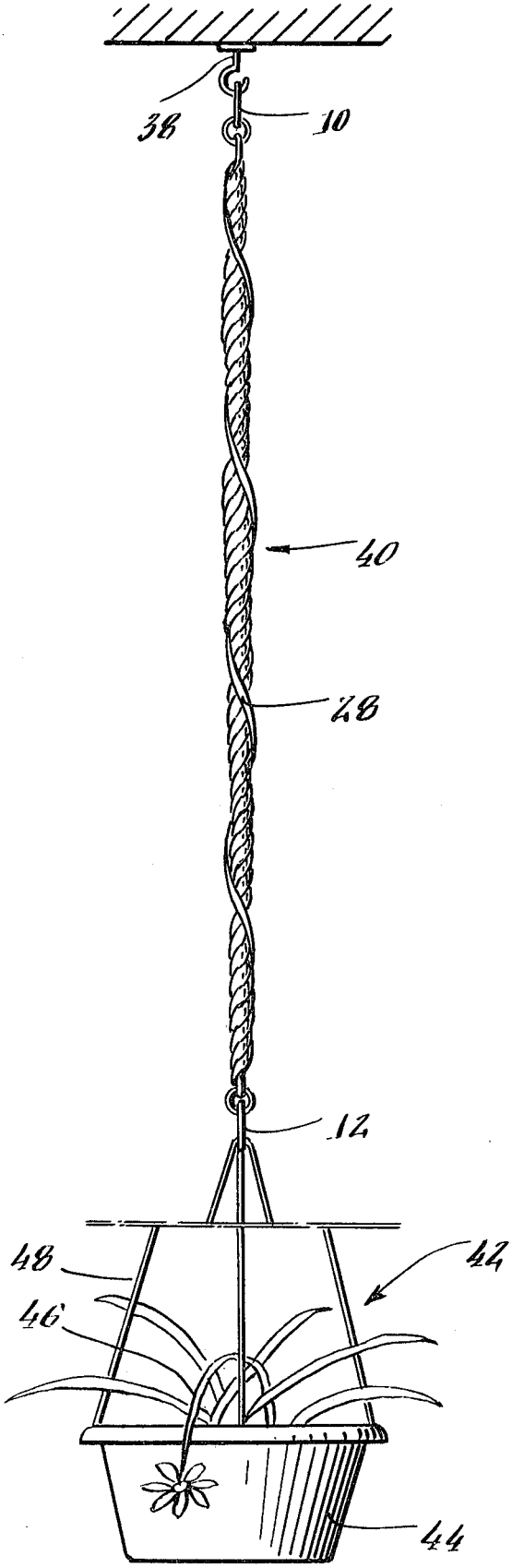
FIG. 6 is a side view of the device shown in FIG. 5 after a plant object has been hung from the device.

Referring to FIGS. 5 and 6, when a weight such as a plant object 42 is hooked on end loop 16, cord 40 winds in one direction as it is extended. By "plant object" it is meant the potting container 44, the soil contained therein, the plant 46 and supporting structure 48 for the potting container. As shown by arrow 50 in FIG. 5, when a weight is loaded on cord 40, cord 40 winds in one direction. As can be seen by comparing FIG. 5 with FIG. 6, inextensible length 28 unwinds while elastic core 22 is simultaneously twisted tighter. The amount of extension of cord 40, of course, depends upon the weight of the potted plant, as well as factors such as the modulus of elasticity of the elastic core 22 and the number of times the core 22 has been twisted and the number of times the inextensible length 28 has been wound around the core.

Figure 7:
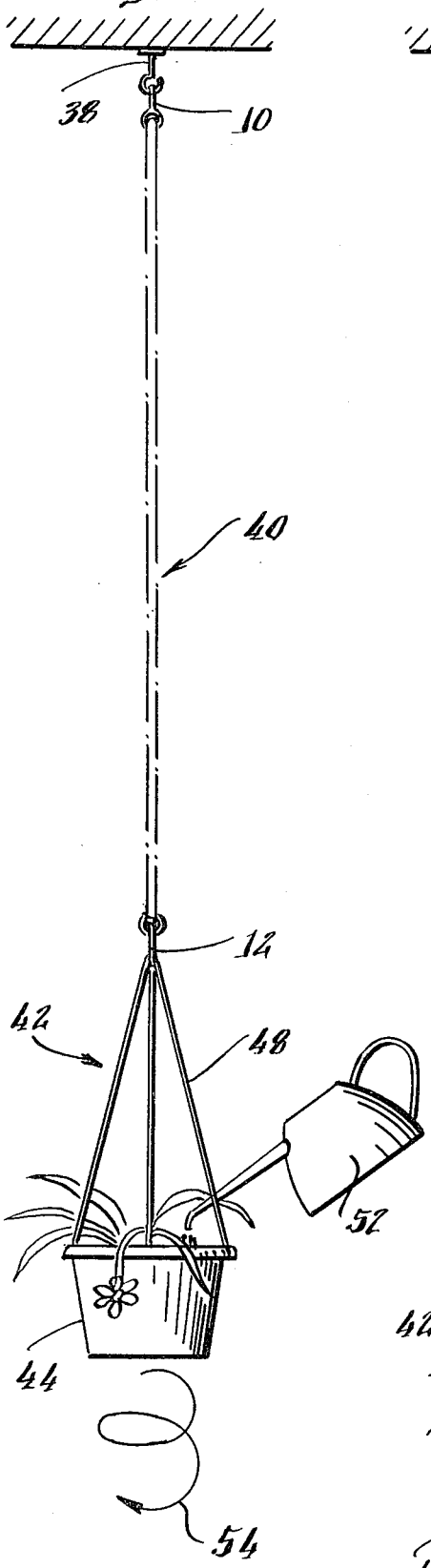
FIG. 7 is a side view of a device in accordance with the present invention just prior to watering of the plant object.
Figure 8:
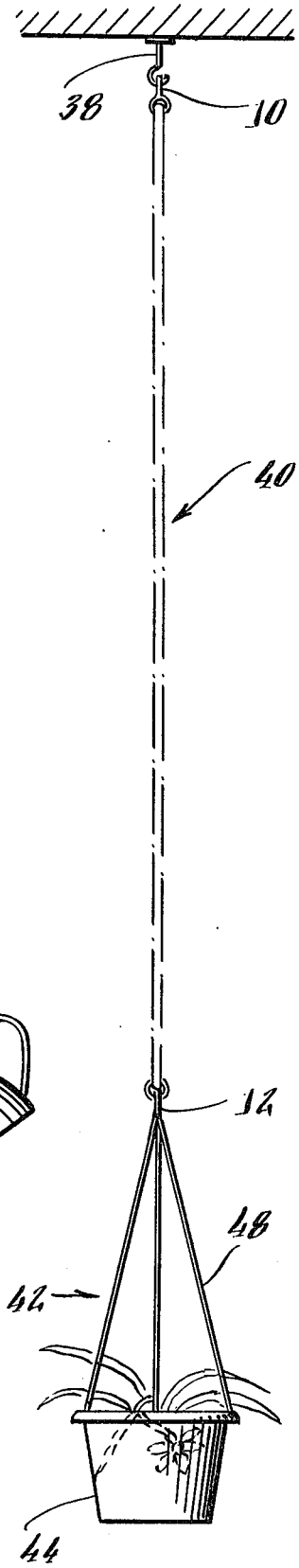
FIG. 8 is a side view of the device after watering of the plant object and after the cord has been extended and the plant has rotated through several turns.
Figure 9:
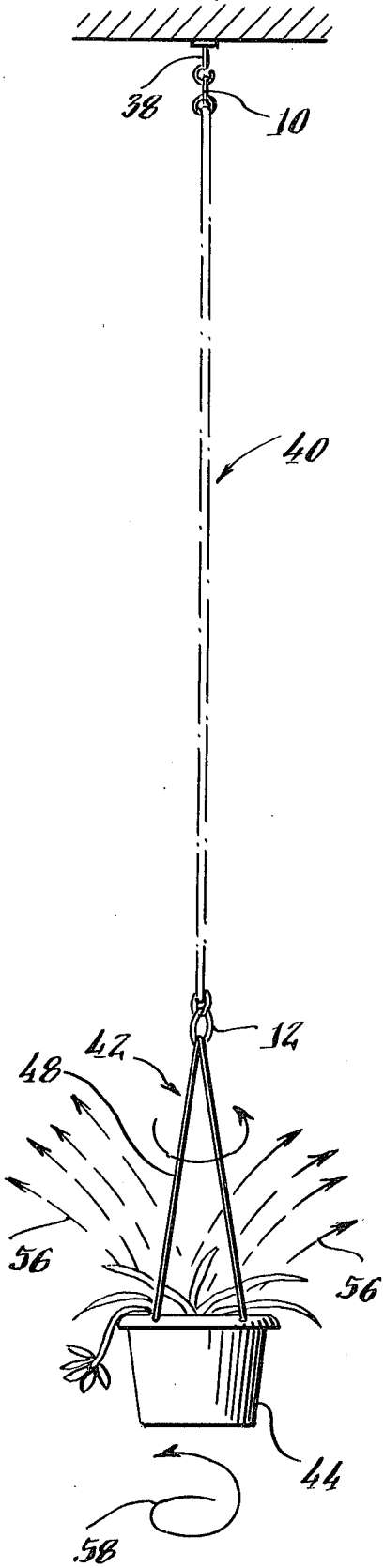
FIG. 9 shows the device shown in FIGS. 7 and 8 after a portion of the water has evaporated and the plant object has rotated in an opposite direction several turns.

Referring to FIGS. 7–9, FIG. 7 shows cord 40 in a loaded condition just prior to the addition of water to plant object 42. As shown in FIG. 7, as water is added to plant object 42 with watering can 52, the weight of the plant object increases and cord 40 is further extended and is further wound in the direction shown by arrow 54. As the weight is added, inextensible length 28 is unwound further and elastic core 22 is twisted even tighter until a force equilibrium is reached as shown in FIG. 8.

Referring to FIGS. 8 and 9, as the water evaporates from plant object 42 as shown by arrows 56 which indicate evaporation of water, the weight of plant object 42 decreases slowly and continuously. As the weight of plant object 42 decreases, the plant object turns in the direction shown by arrow 58 in FIG. 9, thus exposing different sides of the plant to sunlight. As the plant object turns in the reverse direction, inextensible length 28 is wound tighter around core 22 and core 22 twists back to its original position.

As shown in the drawings, the support 48 for the plant pot is a rigid metal wire structure that is attached to the plant pot. It should be understood that in the event that the pot does not have a support provided therewith, a conventional three or four strand sling that will support the plant pot can be attached to the bottom end of the cord.

For a given cord 40, the number of times the plant object turns is a function of the amount of extension of the cord 40. The properties of a given cord are dependent on several factors including the modulus of elasticity of the elastic core, a number of times the elastic core has initially been twisted, the number of times the inextensible length has been wound around the elastic core, the lengths of the elastic core and the inextensible length and the length of the combined cord. The following examples show experimental results of two cords.

EXAMPLES

The following are examples showing the specifications and the performance of two cords in accordance with the present invention. Table I shows the specifications of two cords.

TABLE I

| SPECIFICATION | CORD A | CORD B |
|---|---|---|
| (a) length of the elastic core | 13" | 13" |
| (b) number of strands of the elastic cord | 4 | 4 |
| (c) cross-sectional dimensions of the elastic core | ⅛"× 1/16" | ⅛"× 1/16" |
| (d) number of twists of the elastic core | 60 | 60 |
| (e) elastic core material | natural rubber | natural rubber |
| (f) length of the inextensible length | 24" | 28" |
| (g) number of windings of inextensible length around the elastic core | 36 | 40 |
| (h) inextensible length material | nylon cord | nylon cord |
| (i) approximate length of yarn that provides an appearance covering | 26" | 31" |
| (j) approximate number of windings of yarn | 36 | 40 |
| (k) unloaded length of the cord | 16" | 16" |

Table II shows the performance of cords A and B as weight is loaded on the cord.

TABLE II

| Total Weight Loaded on the Cord (in lbs.) | CORD A Incremental Number of Full Turns of Cord TURNS | CORD B Incremental Number of Full Turns of Cord TURNS |
|---|---|---|
| 1.0 | 0 | 0 |
| 1.5 | .4 | .2 |
| 2.0 | 1.1 | .8 |
| 2.5 | 1.3 | 1.4 |
| 3.0 | 1.7 | 1.8 |
| 3.5 | 1.9 | 2.2 |
| 4.0 | 1.9 | 2.7 |
| 4.5 | 1.7 | 2.1 |
| 5.0 | 1.4 | 2.1 |
| 5.5 | 1.0 | 1.3 |
| 6.0 | .7 | 1.2 |
| 6.5 | .5 | 1.2 |
| 7.0 | .6 | .8 |
| 7.5 | .4 | .6 |

After the addition of 7.5 lbs to the cords, Cord A extended 8.7 inches while Cord B extended 12.8 inches from an initial length of 16 inches.

As can be seen from the above examples, the addition of one-half a pound (8 oz. of water) typically results in the plant object turning in excess of one rotation. As water evaporates, the plant object rotates slowly in a reverse direction to expose different sides of the plant object to sunlight.

It should be understood that although specific embodiments of the invention have been described herein in detail, such description is for purposes of illustration only and modifications may be made thereto by those skilled in the art within the scope of the invention.

What is claimed is:

1. A device for supporting a hanging plant object with respect to a fixed object and for slowly rotating the plant object to expose different sides to sunlight, the device consisting essentially of:

a cord having one end for attachment to said fixed object and having another end for attachment to said plant object, said cord being longitudinally extensible in response to an increase in the weight of said plant object and being longitudinally contractable in response to a decrease in the weight of said plant object, said cord including an elongate elastic core, said core being twisted about its longitudinal axis in one direction, and a flexible substantially inextensible length, said length being wound about said core in a generally helical pattern along the longitudinal axis of the core in a direction opposite to the direction said elastic core is twisted, said inextensible length having one end attached to one end of the twisted core and having another end attached to an opposite end of the twisted core, said elastic core being maintained in said twisted condition by said inextensible length when said cord is not supporting said plant object, upon an increase in weight of said plant object said elongate elastic core extending in length and twisting more tightly and said inextensible length unwinding thereby rotating the plant object in one direction, and upon a decrease in weight of said plant object said elongate elastic core contracting in length and untwisting and said inextensible length winding thereby rotating said plant object in a direction opposite said one direction; and means secured to each end of said cord for supporting said plant object and attaching said fixed object.

2. A device according to claim 1 wherein said elastic core comprises at least one elastic strand.

3. A device according to claim 2 and further including an appearance cover for said elastic core and said inextensible length, said cover comprises a length of material helically wound about the longitudinal axis of said cord.

4. A device according to claim 3 and further including ring members on both ends of said cord, the ends of said elastic core and said inextensible length being attached to said ring members.

* * * * *